US007049754B2

(12) United States Patent
Verdun

(10) Patent No.: US 7,049,754 B2
(45) Date of Patent: May 23, 2006

(54) SYSTEM AND METHOD FOR REDUCING INFORMATION HANDLING SYSTEM DISTRIBUTED CAPACITANCE

(75) Inventor: Gary Verdun, Belton, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/885,441

(22) Filed: Jul. 6, 2004

(65) Prior Publication Data

US 2006/0006810 A1 Jan. 12, 2006

(51) Int. Cl.
*H05B 37/00* (2006.01)

(52) U.S. Cl. ..... 315/169.3; 345/102

(58) Field of Classification Search ..... None
See application file for complete search history.

(56) References Cited

U.S. PATENT DOCUMENTS 6,919,697 B1 * 7/2005 Jang ..... 315/291
2002/0003525 A1 * 1/2002 Hwang ..... 345/102
2002/0041280 A1 4/2002 Woo ..... 345/212

* cited by examiner

*Primary Examiner*—David Vu
(74) *Attorney, Agent, or Firm*—Hamilton & Terrile, LLP; Robert W. Holland

(57) ABSTRACT

The impact of distributed capacitance on information handling system operations is reduced by introducing an impedance element in series with the ground of the source of the distributed capacitance for an overall reduction of capacitance. For instance, distributed capacitance is formed between a liquid crystal display illumination lamp and ground through a reflector disposed proximate the lamp and aligned so that an interior reflecting surface directs light toward imaging pixels. An insulating dielectric added to the outer surface of reflector and assembled to information handling system chassis ground with some surface area in common between the reflector and the system ground form a separate series capacitor between the lamp and ground. The insulation dielectric capacitance combines in series with the reflector capacitance to provide a resultant capacitance of less than the reflector capacitance. Reduced distributed capacitance of the lamp and wiring to ground reduces power loss and improves illumination brightness distribution across the lamp.

20 Claims, 4 Drawing Sheets

SYSTEM AND METHOD FOR REDUCING INFORMATION HANDLING SYSTEM DISTRIBUTED CAPACITANCE

BACKGROUND OF THE INVENTION

1. Field of the Invention

The present invention relates in general to the field of information handling system distributed capacitance, and more particularly to a system and method for reducing the effect of distributed capacitance associated with light generation to illuminate a liquid crystal display using Cold Cathode Fluorescent Light (CCFL).

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems are sometimes assembled in portable configurations to allow a user to operate the information handling system independent of external peripherals and external power. Typical portable information handling systems include an integrated power supply, such as an internal rechargeable battery, and an integrated display, such as a liquid crystal display (LCD) integrated in a lid that opens for operation and shuts for storage. The LCD generates a display by altering the light-passage characteristics of pixels so that light that passes from the back of the display through the pixels presents a desired image. The backlight that generates light to illuminate the pixels is typically a fluorescent light, such as a cold cathode fluorescent lamp (CCFL), aligned along an edge of the display to pass light through a light guide for even distribution across the display. Generally, the CCFL is placed in a semi-circle shaped reflector to direct light into the light guide.

CCFL lights are typically used as portable display backlights due to the relatively effective illumination provided with relatively low power consumption and heat generation. Often, portable information handling system displays are the system component that takes the greatest toll on internal battery charge life when the information handling system operates on internal power. Internal battery direct current power is converted to high voltage and high frequency alternating current with an internal inverter, such as voltages of approximately 600 Volts and frequency of approximately 50 KHz. One difficulty that arises with the transmission of high voltages and frequencies through a CCFL is that the passage of the current through the CCFL gas plasma results in generation of distributed capacitance where grounded metallic surfaces are proximate to the CCFL. For example, the semi-circle shaped reflector that directs light to the light guide is typically metallic and generally grounded for ease of assembly and reduced electromagnetic emissions (EMI). The proximity of the reflector to the lamp and its length form one side of the distributed capacitance that affects power transmitted from the inverter to the ground of the lamp. Distributed capacitance often increases power consumption by 10 to 20% and also impacts the quality of light produced by making the brightness across the lamp uneven. Increased power consumption due to distributed capacitance of the lamp and wiring to system ground thus may have a substantial negative impact on a portable information handling system's battery charge life.

SUMMARY OF THE INVENTION

Therefore a need has arisen for a system and method which reduces the impact of distributed capacitance on information handling system operations.

In accordance with the present invention, a system and method are provided which substantially reduce the disadvantages and problems associated with previous methods and systems for managing distributed capacitance. An impedance element interfaced in series between a display lamp reflector and ground provides a reduced resultant distributed capacitance for less power waste and improved lamp illumination.

More specifically, an information handling system display presents image information through image pixel elements that are illuminated by a fluorescent lamp, such as a CCFL. A reflector aligned along the length of the lamp directs light generated by the lamp to a light guide for distribution across the image elements. Physical distributed capacitance forms between the grounded metal inner surface of the reflector and the lamp due to the alternating current path from an inverter to the lamp and then to ground. The impact of the physical distributed capacitance on information handling system operations is reduced by interfacing an impedance element in series with the distributed capacitance between the lamp and ground to provide a reduced resultant distributed capacitance. In one embodiment, the impedance element is a capacitor integrated with the lamp assembly by encasing the outer surface of the reflector with an insulating dielectric assembled to ground and having some common surface area between the reflector and ground, such as the frame of the information handling system.

The present invention provides a number of important technical advantages. One example of an important technical advantage is that introduction of capacitance or other impedance element in series with distributed capacitance formed between a lamp and ground reduces the impact of the distributed capacitance on display illumination by the lamp, such as a CCFL. Reduced distributed capacitance reduces power loss by display illumination to increase effective portable information handling system battery life. Reduced distributed capacitance also stabilizes power to the display lamp for more even brightness and thus improved image quality of the display.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Physical distributed capacitance formed by current flow through information handling system components increases power use and impacts system performance. Distributed capacitance is reduced by interfacing an impedance element in series with the source of the distributed capacitance to produce a lower resultant capacitance. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
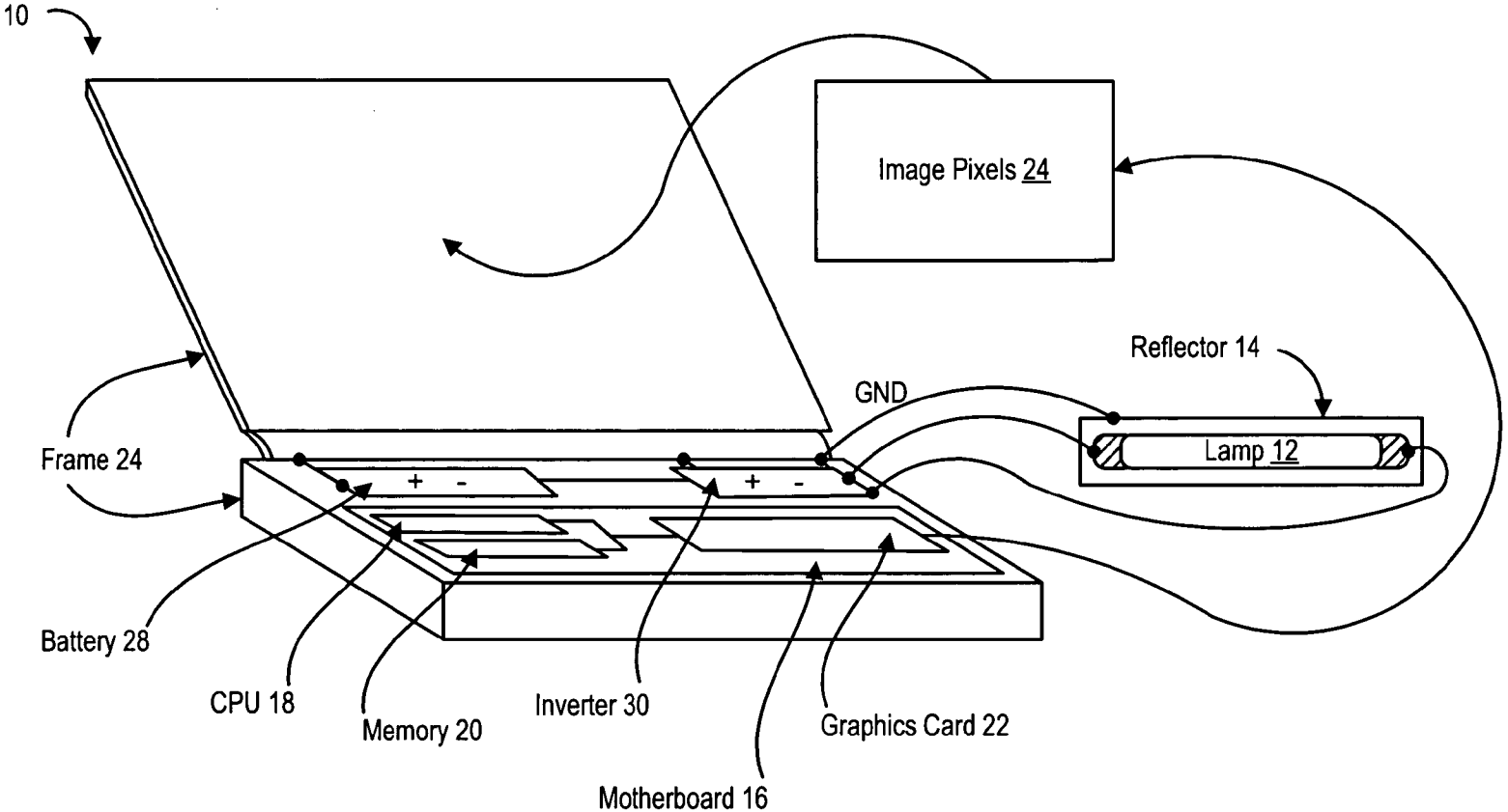
FIG. 1 depicts a blown-up side perspective view of a portable information handling system having a lamp and a reflector that interact to form distributed capacitance.

Referring now to FIG. 1, a block diagram depicts a blown-up side perspective view of a portable information handling system 10 having a lamp 12 and a reflector 14 that interact to form distributed capacitance. Information handling system 10 has internal processing components to generate image information for display, such as a motherboard 16 that supports a CPU 18, memory 20 and a graphics card 22. Image information is communicated from graphics card 22 to image pixels 24 to form images from the information for presentation to a user. Lamp 12 provides backlight to illuminate image pixels 24 with reflector 14 directing light from lamp 12 to image pixels 24. Image pixels 24 are assembled as a liquid crystal display coupled to the hinged lid of a frame 26 that secures the processing components. Frame 26 is metallic and electrically conductive to act as a common system ground.

Information handling system 10 is powered with direct current from a battery 28 that is grounded to frame 26. Battery 28 provides direct current to inverter 30, which converts the direct current to alternating current for supply to lamp 12. For instance, inverter 30 provides alternating current of approximately 600 Volts and approximately 50 KHz to a CCFL that illuminates image pixels 24. The relatively high voltage and high frequency applied by inverter 30 to lamp 12 generates current through the physical distributed capacitance associated with lamp 12 and the wiring of lamp 12 to ground through inverter 30. The greater the physical distributed capacitance associated with operation of lamp 12, the greater the amount of power that is wasted for a given illumination of lamp 12. Metal of reflector 14 in proximity to lamp 12 and along the length of lamp 12 plus wiring of reflector 14 to ground form the opposing side of the physical distributed capacitance along the length corresponding between lamp 12 and reflector 14.

Figure 2A:
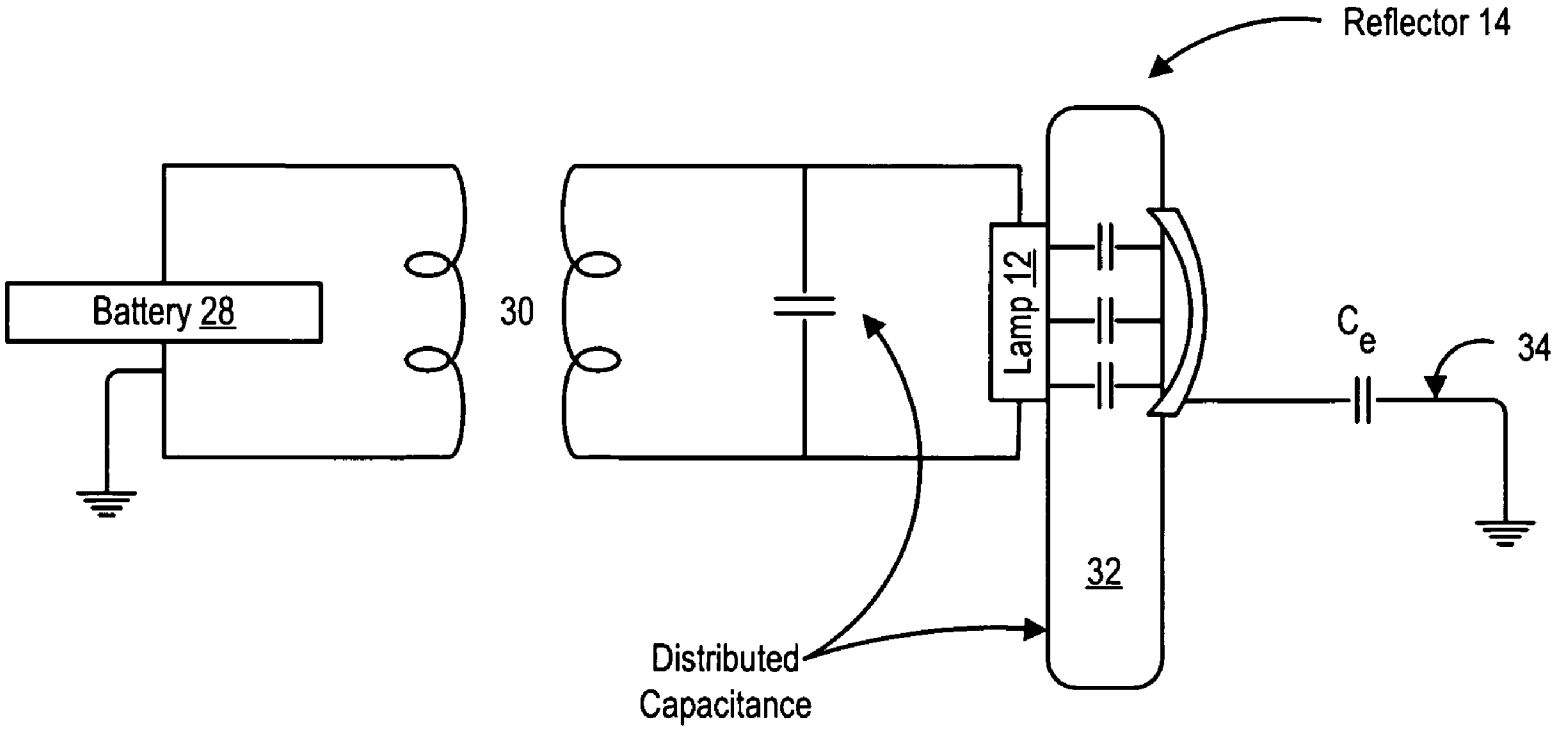
FIG. 2A depicts a circuit diagram of a system for decreasing the impact of distributed capacitance to the resultant of the reflector capacitance in series with a capacitance element.
Figure 2B:
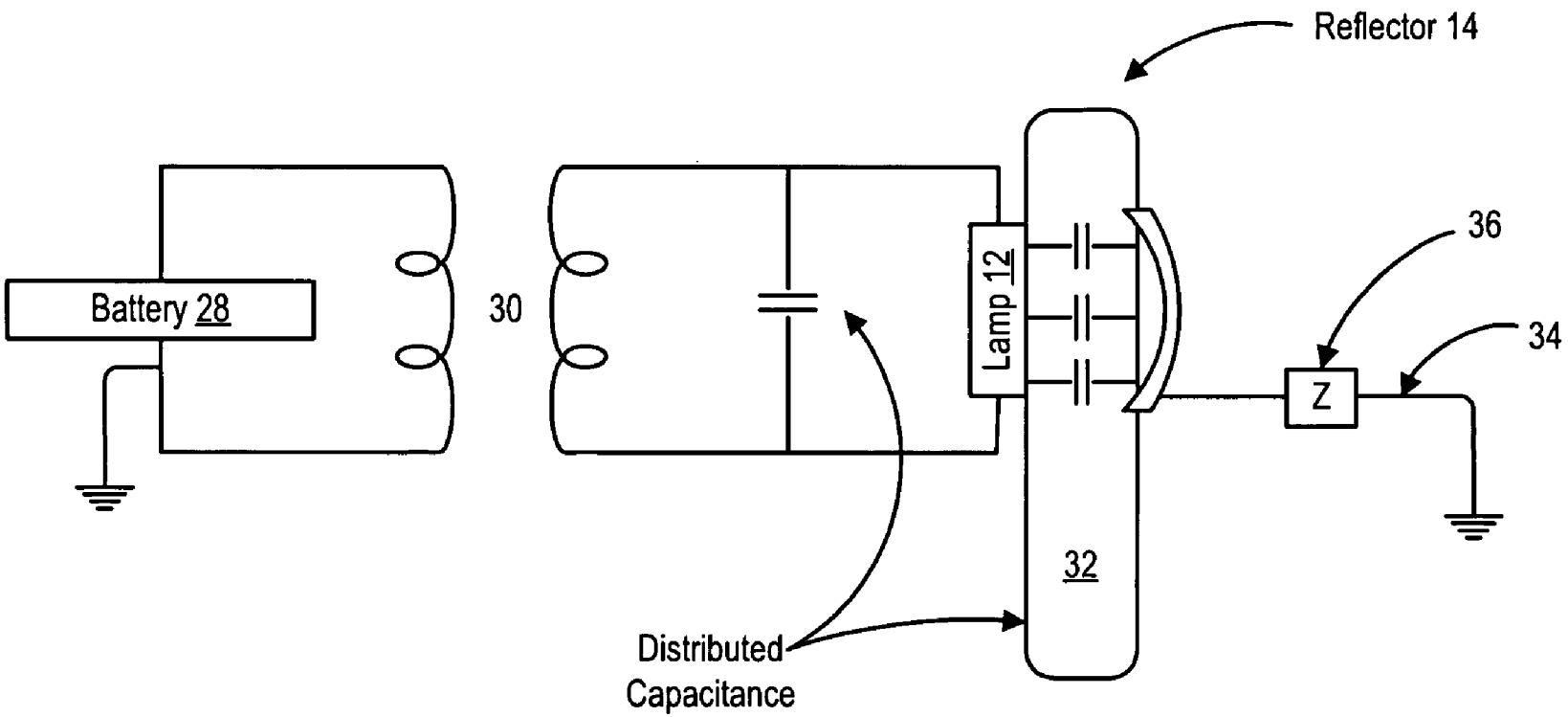
FIG. 2B depicts a circuit diagram of a system for decreasing the impact of distributed capacitance to the resultant of the reflector capacitance in series with an impedance element.

Referring now to FIGS. 2A and 2B, a circuit diagram depicts physical distributed capacitance associated with a reflector proximate to a lamp 12. The physical distributed capacitance is reduced to the resultant of the reflector capacitance in series with a capacitor 34 or other impedance element 36, as depicted by FIG. 2A, or other impedance element 34 as depicted by FIG. 2B. Physical distributed capacitance, annotated as $C_T$ in the circuit, is spread across the length of reflector 14 as a result of the current path for alternating current provided by a plasma arc through lamp 12. For instance, the implied capacitors 32 between lamp 12 and reflector 14 illustrate the forming of the physical distributed capacitance along the length of the grounded reflector 14. In order to reduce this reflector-associated distributed capacitance, a second capacitance 34, annotated $C_E$, or other impedance 36, annotated Z, is disposed in series with the reflector to ground wiring. Series capacitors combine to yield a lower capacitance than any single capacitor in the string so that placing a capacitor $C_E$ in series with the physical distributed capacitance will provide a reduced resultant capacitance. The resultant capacitance is determined from the formula:

$$\frac{1}{1/C_T + 1/C_E}$$

In one embodiment, the values for Z are selected to further minimize the effects of distributed capacitance in the frequency domain, such as by matching the frequency of the alternating current that passes through lamp 12.

Figure 3:
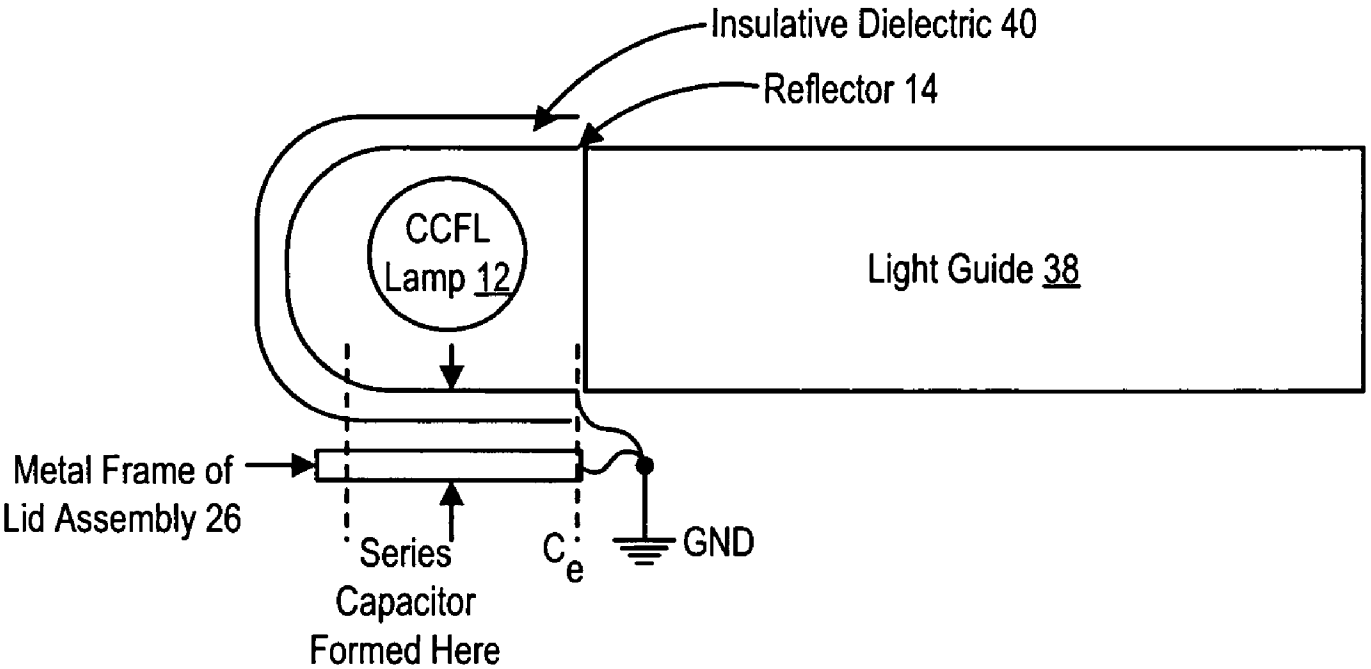
FIG. 3 depicts a side cutaway view of a display lamp configured with an insulating dielectric to form capacitance in series with the reflector capacitance.

Referring now to FIG. 3, a side cutaway view of a display lamp assembly is depicted configured with an insulating dielectric to form capacitance $C_E$ in series with the reflector capacitance. CCFL lamp 12 provides light to a light guide 38 that distributes the light across LCD pixels. Reflector 14 directs light towards light guide 38 with a reflective foil surface that is interfaced with system ground through frame 26. In order to integrate capacitance $C_E$ into the lamp assembly, an insulating dielectric is placed around the outer surface of reflector 14 and assembled to system ground with frame 26 so that some surface area of dielectric 40 is between reflector 14 and frame 26. A series capacitance is thus formed separate from the reflector-lamp distributed capacitance and between lamp 12 and ground. The desired impact of the series capacitance on the distributed capacitance is adjusted with the surface area alignment of the reflector, dielectric and frame and the selection of the dielectric material. Smaller capacitance values provide a reduced resultant distributed capacitance to reduce power loss from lamp illumination and to provide more even brightness distribution across the lamp.

Although the present invention has been described in detail, it should be understood that various changes, substitutions and alterations can be made hereto without departing from the spirit and scope of the invention as defined by the appended claims.

What is claimed is:

1. An information handling system display comprising:

image elements operable to present information as an image;

a lamp operable to pass light through the image elements to illuminate the image;

a reflector proximate the lamp and aligned to direct light from the lamp to the image elements, the reflector interfaced with a ground;

an inverter interfaced with the lamp and operable to apply electrical power from a power source to the lamp, the electrical power application to the lamp introducing current in distributed capacitance between the lamp and ground by the proximity of the reflector; and an impedance element interfaced between the reflector and ground in series with the distributed capacitance, the impedance element operable to reduce the distributed capacitance.

2. The information handling system display of claim 1 wherein the impedance element comprises a capacitive element.

3. The information handling system display of claim 2 wherein the capacitive element comprises:

an insulating dielectric disposed proximate the reflector; and a grounded conductive structure proximate the insulating dielectric, the grounded conductive structure having a surface area with the reflector ground;

wherein the insulating dielectric and grounded conductive structure form a capacitance of less than the distributed capacitance.

4. The information handling system display of claim 1 wherein the lamp comprises a fluorescent lamp operating at a predetermined alternating current voltage and frequency.

5. The information handling system display of claim 4 wherein the impedance element matches the frequency of the fluorescent lamp.

6. The information handling system display of claim 4 wherein the fluorescent lamp comprises a CCFL.

7. The system of claim 4 wherein the power source comprises a direct current battery.

8. The system of claim 7 wherein the image elements comprise liquid crystal display pixels.

9. A method for display of information, the method comprising:

running an alternating current through a lamp to generate light;

aligning a reflector proximate the lamp to direct light from the lamp towards image elements that display an image;

grounding the reflector; and inserting an impedance element in series with reflector ground between the reflector and ground.

10. The method of claim 9 wherein the lamp comprises a fluorescent lamp operating with an alternating current having a frequency of approximately 50 KHz and a voltage of approximately 600 Volts, the alternating current forming a physical distributed capacitance with the reflector, the impedance element having a capacitance of less than the physical distributed capacitance.

11. The method of claim 9 wherein the alternating current and the impedance element have operating frequencies, the method further comprising:

selecting the impedance element to match the alternating current operating frequency.

12. The method of claim 9 wherein the lamp comprises a CCFL.

13. The method of claim 9 wherein inserting an impedance element further comprises:

insulating the reflector with a dielectric; and assembling the dielectric to ground to have a portion of the surface area of the dielectric in common between the reflector and the ground to form a capacitance in series with distributed capacitance formed by passing the alternating current through the lamp proximate the reflector.

14. The method of claim 13 wherein running an alternating current further comprises:

providing a direct current from an information handling system battery to an inverter;

transforming the direct current into the alternating current with the inverter; and transmitting the alternating current from the inverter to the lamp.

15. The method of claim 14 further comprising:

generating image information with the information handling system; and displaying the image information with a liquid crystal display illuminated by the light.

16. An information handling system comprising:

a chassis having a metal frame with a hinged lid;

processing components disposed in the chassis and operable to generate information to display an image;

image elements disposed in the chassis lid and interfaced with the processing components, the image components operable to form an image from the information generated by the processing components;

a battery disposed in the chassis and operable to provide direct current to power the processing components, the battery ground provided through the metal frame;

an inverter disposed in the chassis, the inverter interfaced with the battery and ground, the inverter operable to transform the direct current to an alternating current;

a lamp disposed in the chassis proximate the image elements and interfaced with the inverter, the lamp having a current path for the alternating current to generate light, the current path interacting with at least a portion of the metal frame to create a physical distributed capacitance; and an impedance element interfaced with the frame in series with the inverter ground, the impedance element reducing the physical distributed capacitance.

17. The information handling system of claim 16 wherein the lamp comprises a fluorescent lamp.

18. The information handling system of claim 16 further comprising a metallic reflector disposed proximate the lamp and interfaced with ground, the metallic reflector interacting with the lamp to form the physical distributed capacitance.

19. The information handling system of claim 18 wherein the impedance element comprises:

an insulating dielectric proximate the reflector and interfaced to the frame, at least a portion of the dielectric disposed between a surface of the reflector and a surface of the frame to form capacitance in series with the lamp and ground.

20. The information handling system of claim 19 wherein the lamp comprises a CCFL.

* * * * *